US010145161B2

(12) United States Patent
Gröne et al.

(10) Patent No.: US 10,145,161 B2
(45) Date of Patent: Dec. 4, 2018

(54) SLIDING DOOR INSTALLATION

(71) Applicant: DORMA Deutschland GmbH, Ennepetal (DE)

(72) Inventors: Kai Gröne, Ennepetal (DE); M. Sandra Klemens, Ennepetal (DE); Andreas Finke, Ennepetal (DE); Arne Liebscher, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 301 days.

(21) Appl. No.: 14/990,376

(22) Filed: Jan. 7, 2016

(65) Prior Publication Data

US 2016/0201376 A1 Jul. 14, 2016

(30) Foreign Application Priority Data

Jan. 14, 2015 (EP) ..... 15151196

(51) Int. Cl.
*E05D 13/00* (2006.01)
*E05F 1/16* (2006.01)
*E06B 3/46* (2006.01)

(52) U.S. Cl.
CPC ..... *E05F 1/16* (2013.01); *E06B 3/4636* (2013.01); *E05Y 2201/488* (2013.01); *E05Y 2800/678* (2013.01); *E05Y 2900/132* (2013.01)

(58) Field of Classification Search
CPC ..... E06B 3/4636; E06B 3/4645; E05F 1/16; E05Y 2900/132; E05Y 2201/448; E05Y 2800/678; E05Y 2900/00
USPC ..... 49/425, 223, 128, 506, 221, 208, 358, 49/370, 125, 127, 130
See application file for complete search history.

(56) References Cited

U.S. PATENT DOCUMENTS 7,845,116 B2 * 12/2010 Masuda ..... E05D 15/1065 49/125
8,857,015 B2 * 10/2014 Hufen ..... E05D 15/063 16/91
2010/0139037 A1 * 6/2010 Hufen ..... E05D 15/063 16/88
2010/0269415 A1 * 10/2010 Busch ..... E05F 15/60 49/358
2012/0285093 A1 * 11/2012 Tarrega Lloret ..... E05F 1/16 49/358
2016/0076290 A1 * 3/2016 Lecot ..... E05D 15/0656 49/404

FOREIGN PATENT DOCUMENTS

DE 102006016604 A1 10/2007

* cited by examiner

*Primary Examiner* — Chi Q Nguyen
(74) *Attorney, Agent, or Firm* — Cantor Colburn LLP

(57) ABSTRACT

A sliding door installation includes a roller running track and at least one roller carriage supported to be displaceable in the roller running track, at which carriage a sliding door is attached. A closing device is provided with an elastic traction means, wherein a first end of the elastic traction means is stationarily attached with regard to the roller running track, and a second end of the elastic traction means is attached to the at least one roller carriage for changing the tensile stress in the elastic traction means during a movement of the roller carriage in the roller running track.

11 Claims, 4 Drawing Sheets

SLIDING DOOR INSTALLATION

TECHNICAL FIELD

The present disclosure relates to a sliding door installation as well as to a method for mounting such a sliding door installation.

BACKGROUND

Generally, it is known to employ sliding door installations to reversibly close door openings. Conventional sliding door installations are equipped with a sliding door for this purpose, which is supported to be displaceable between an opened position and a closed position by means of a roller carriage. In this case, for said displaceable movement, the roller carriage is supported in a corresponding roller running track. In the known sliding door installations, usually the opening and the closing are purely manually accomplished, namely by means of actively manually sliding the sliding door open or closed. Also, motor drives are known, which produce the opening procedure and the closing procedure with a corresponding provided motor driving force.

The known solutions are disadvantageous in that with regard to a purely manual solution, there is the risk of the sliding door not being completely closed or not being closed at all, after a user has passed through the door opening. This circumstance my result in reduced insulating properties of the sliding door, namely the insulation from sound and the insulation against loss of heat. In other words, in particular in passage areas, where the door opening is frequently passed, reliable closing of the sliding door after it has been passed is of great advantage. Employing motor drives as a solution to this problem entails in addition high cost. Also, the drive has a heavy weight and moreover, the space requirement for such a motor drive needs to be considered in the associated system.

Therefore, the present disclosure aims to overcome the above-described disadvantages at least partially. The present disclosure aims to improve the comfort and the described protecting effect of a sliding door installation in a cost-effective and simple manner.

Further features and details of the disclosure will result from the description and the drawings. In this case, features and details, described in conjunction with the inventive sliding door installation, are obviously also valid in conjunction with the inventive method and respectively vice versa, such that mutual reference is made, respectively can be made with respect to the disclosure of individual aspects of the disclosure.

SUMMARY

According to the disclosure, a sliding door installation is provided, which includes a roller running track and at least one roller carriage supported to be displaceable in the roller running track, wherein a sliding door is attached to the roller carriage. An inventive sliding door installation is distinguished in that a closing device with an elastic traction means is provided. In this case, a first end of the elastic traction means is stationarily attached with regard to the roller running track. A second end of the elastic traction means is attached to the at least one roller carriage for changing the tensile stress in the elastic traction means during a movement of the roller carriage in the roller running track.

According to the disclosure, also a sliding door having two or more door leaves can be provided such that accordingly also two or more roller carriages are provided. Furthermore, each one of the door leaves of a sliding door may be attached to two roller carriages as well. Usually, such multi-leaf sliding doors are built with a telescopic function such that telescoping relatively narrow door leaves can cover a relatively large door opening.

A closing device according to the idea of the present disclosure serves in particular exclusively for the closing movement of the sliding door. Accordingly, the opening movement of the sliding door is still performed manually. Therefore, the closing device serves for assisting, respectively in particular for completely automatically performing the closing procedure. This means that the closing device provides the necessary closing force, wherein preferably the closing force is also in effect during the entire opening procedure.

For providing the above function, an inventive closing device is equipped with an elastic traction means. A structural component, which is able to experience an elastic transformation, is understood as an elastic traction means. An elastic transformation is produced in that a force is applied for performing said elastic transformation. Accordingly, by stretching the elastic traction means said necessary force is stored in the form of tensile stress in the elastic traction means. In this case, the movement of the roller carriage and the corresponding correlation of the two ends of the elastic traction means also provide a correlation between the tensile stress in the elastic traction means and the position of the roller carriage.

If the roller carriage moves together with the sliding door from the closed position into the opened position, this continues to be performed by manual actuation by the user. In other words, the user slides the sliding door into its opened position and thereby moves the roller carriage correspondingly on the roller running track. By connecting the second end to the roller carriage and the first end in a stationary manner with regard to the roller running track, this circumstance results in that the length of the elastic traction means changes. In particular, the length of the elastic traction means considerably lengthens by elastic deformation by being pulled lengthwise. Said elastic deformation results in increasing the tensile stress within the elastic traction means during the movement of the roller carriage into the opened position. Now, if the user or another mechanical device, in the shape of a latching device, as will be explained later, releases the sliding door and/or the roller carriage when they are in the opened position, the stored tensile stress can be released from the elastic traction means to the roller carriage, respectively to the sliding door. While the occurred elastic deformation of the elastic traction means reduces, now the tensile stress is released and in this way with the generated force, a movement of the roller carriage and thereby of the sliding door is performed. Said movement is opposite to the opening movement and accordingly performs the closing movement of the sliding door. In other words, now an automatic movement of the roller carriage and of the sliding door is realized into the closed position, while employing the tensile stress stored as force in the elastic traction means.

As can be understood from the above paragraph, it may be additionally of importance, if particular attention is paid to the spring characteristic of the elastic traction means. Thus, the tensile stress within the elastic traction means will depend on the spring characteristic and on the actual deformation, namely the geometric amount of the deformation. In other words, if the tensile stress increases when opening the sliding door, the tensile stress reduces when the sliding door automatically closes.

According to the disclosure, now a particularly simple, compact system, reduced with regard to the complexity thereof will be provided for realizing a sliding door installation. However, without unnecessary high expenses with regard to a motor drive, the closing device is able to provide automatic closing, in particular complete automatic closing. Preferably, the elastic traction means is employed in a pre-tensioned manner for this purpose such that also in the closed position of the roller carriage, respectively of the sliding door, a corresponding pre-tension ensures that the sliding door is loaded with force, respectively is retained in said closed position. Therefore, not only the basic degree of automation of the closing movement is provided, but moreover, it is also ensured that the sliding door actually closes completely. This is of considerable importance in particular with regard to sound insulation and/or thermal insulation of two areas separated by means of the sliding door.

It may be advantageous, if in an inventive sliding door installation, the closing device includes at least one redirection means, about which the elastic traction means is guided between the two ends for a lengthening of the geometrical extension of the elastic traction means. In this case, a redirection means may be configured to be rotatable, in particular supported by means of ball bearings. However, sliding of the elastic traction means over a surface of the redirection means is conceivable. Thus, a redirection means serves for lengthening the geometrical extension of the elastic traction means. In other words, a housing may be affixed above the door opening, wherein said housing includes for example the roller running track. By redirecting the elastic traction means by means of the redirection means, it is now possible to delimit the housing to the extension of the roller running track and still allow for a considerable lengthening of the elastic traction means. In this case, the geometrical extension of the elastic traction means may act in that an improved spring characteristic be built. Thus, it is advantageous, if with redirection means in particular a multiple length of the elastic traction means is provided in relation to the width of the roller running track. The longer the geometrical extension of the elastic traction means can be made, the flatter the spring characteristic can be provided within the maneuver clearance of the roller carriage. The flatter said spring characteristics are designed the lower the acceleration of the roller carriage during the automatic closing movement. This results in a considerably improved and in particular quieter closing movement of the roller carriage, because it is slower. Moreover, the durable stability of the elastic traction means can be reinforced in this way, because the actual applied tensile stress can be designed with lower maximum values. Last but not least, the difference between the opened position and the closed position of the sliding door can be considerably improved, respectively minimized for the tensile stress in the elastic traction means by lengthening the geometrical extension by means of the redirection means. A subsequent adaptation to a pretension, respectively the difference with regard to the spring characteristics is for example conceivable by means of a corresponding variable support of the redirection means. Thus, for example redirection rollers could be provided at the two lateral ends of a roller running track, about which the elastic traction means is guided. In this case, the bearing axes of the redirection means can be attached in oblong holes for correspondingly increasing or reducing a pretension of the elastic traction means by means of lateral displacement.

Another advantage may be, if, in an inventive sliding door installation, the closing device and/or the elastic traction means fulfill/s at least one of the following parameter ranges:

- maximum tensile stress with the sliding door being opened between 20 N and 35 N,
- maximum tensile stress with the sliding door being closed between 10 N and 25 N,
- difference between tensile stress with the sliding door being opened and tensile stress with the sliding door being closed between 5 N and 25 N,
- length of the elastic traction means in the neutral fiber between 4 m and 5 m in the mounting condition,
- exterior diameter of the elastic traction means in the range between 5 mm to 8 mm.

The above parameter ranges may correlate in particular with correspondingly flat designed spring characteristics, as explained in the above paragraph. Obviously, the described listing is understood as non-exhaustive. An exterior diameter is in particular preferred in the range of about approximately 6 mm. In this case, the length of the elastic traction means in the neutral fiber is related to the mounting condition and is thereby already pretensioned. This is in particular the mounting situation in a roller carriage, which is located in the closed position associated to the sliding door.

It is likewise advantageous, if, in an inventive sliding door installation, the first end of the traction means is attached with a first knot stationarily with regard to the roller running track and/or the second end of the traction means is attached with a second knot to the at least one roller carriage. A particularly simple and cost-effective mounting is thereby made possible. Also, adjusting the pretension can be performed particularly simple, cost-effectively and fast. Last but not least, it is possible in this way to provide for a later variation of the pretension, without having to perform expensive maintenance work. Thus, loosening the knot and retightening the knot at a different location, changes the tension very quickly and simply. A corresponding overhang of the end of the elastic traction means may be fixed to the respective attachment point, for example by means of cable ties. Moreover, such an embodiment allows for providing a free, in particular infinitely variable pretension. In this case, the elastic traction means may include a surface, respectively a material configuration, which favors, respectively simplifies manual loosening the knot. In this case, it may be question for example of a monofile woven wrapping. As an alternative to the knot, clamping elements can be employed, which are pressed at the corresponding end of the elastic traction means. Also, oblong holes can be provided, which allow for a height varied connection of the respective end of the elastic traction means to the roller carriage, respectively to the corresponding attachment point of the roller running track.

Obviously, it is basically also conceivable, that, in an inventive sliding door installation, the first end of the traction means is attached with a first knot to the at least one roller carriage and/or the second end of the traction means is attached with a second knot stationarily with regard to a roller running track.

Moreover, it is advantageous, if, in an inventive sliding door installation, a dampening device is provided for dampening the movement of the roller carriage, in particular exclusively into a first terminal position, which corresponds to the closed position of the sliding door. Said dampening device thus dampens the automatic closing movement. Simultaneously, the dampening device is configured to leave the opening movement un-charged with regard to a dampening force. This means, the individual user can perform the manual opening movement in a known manner. Just the closing movement and in particular only the terminal portion of the closing movement, which is automated by means of the released tensile stress from the elastic traction means, will be dampened by the dampening device. Such a dampening device may be configured as a spring dampening system. Obviously, also a pure dampening configuration of the dampening device is conceivable such that the associated spring function is fulfilled by the spring-elastic configuration of the elastic traction means. However, basically it is also conceivable to charge the dampening device with regard to the opening movement thereof with a dampening force without compromising the functionality of the inventive dampening device.

It may be likewise advantageous, if, in an inventive sliding door installation, a latching device is provided with a mobile latching element, which is disposed at the roller carriage, and a stationary fixing element in relation the roller running track for the reversible latching cooperation with the latching element in the roller carriage in a second terminal position, which corresponds to the opened position of the sliding door. Thus, such a latching device serves for keeping the sliding door in the opened condition. Such a latching element may have for example a hook-shaped or ball-shaped embodiment. The fixing element has corresponding complementary geometrics such that in particular at least sectionwise a positive connection can be established between the latching element and the fixing element. In this case, the latching position can be occupied by means of the elastic deformation of the latching element and/or of the fixing element. Now, said position is cancelled by means of correspondingly loosening the latching device, and the tensile stress stored in the elastic traction means can be released for the automatic closing procedure. In this case, the required latching force is preferably in the range of approximately 30 N. As an alternative to mechanically, in particular positively operating latching devices, according to the idea of the disclosure, also embodiments with magnets are conceivable. In this case, it may be question of magnetizable, electromagnetic or also permanent magnetic materials.

It is likewise moreover advantageous, if, in an inventive sliding door installation, the latching device includes a trigger device for cancelling the latched cooperation between the latching element and the fixing element during a movement of the roller carriage beyond said second terminal position. This results in a particularly simple and cost-effective solution for performing the automatic closing procedure. In the event the roller carriage, respectively the sliding door is in the second terminal position, namely in the opened position of the sliding door, a movement beyond said second terminal position will trigger the respective trigger function. Thereby, the release, respectively cancelling the latching cooperation is realized such that without separate trigger means, the release of the tensile stress from the elastic traction means is realized. In this case, the movement beyond the second terminal position is in particular less than approximately 5% of the preceding overall opening movement between the two terminal positions of the roller carriage.

Another advantage is found, if, in an inventive sliding door installation, the elastic traction means includes at least one of the following embodiments:

- woven rubber cord
- silicone round cord
- silicone tube.

The above enumeration is a non-exhaustive listing. In particular, the elastic traction means is configured in a rope-shaped extension. Obviously, in axial direction also other embodiments can be combined with each other. Also the elastic traction means may include two or more, in particular parallel extending strands of individual traction means parts.

Another advantage can be achieved, if, in an inventive sliding door installation, the elastic traction means has tensile stress characteristics with a difference of the tensile stress in the traction means between a first terminal position of the roller carriage, which corresponds to the closed position of the sliding door, and a second terminal position of the roller carriage, which corresponds to the opened position of the sliding door, wherein the difference is designed between 50% and 200% of the pretension of elastic traction means in the first position of the roller carriage. This means that the tensile stress between the two terminal positions just increases in the range between 50% and 200% with regard to the pretension. In the event the pretension is given for example at 10 N in a defined way in the traction means, this means that the increase between the two terminal positions will be realized in the range between 5 N to 20 N. In relation to the pretension, this translates to providing just a small increase of the tensile stress and thereby translates into flat spring characteristics—what the tensile stress characteristics are also referred to—for the elastic traction means between the two terminal positions. This translates into the advantages with regard to the automatic closing movement, which have been described already several times, in particular with regard to a slower and thereby more uniform movement.

Another advantage is found, if, in an inventive sliding door installation, the length of the elastic traction means between the first end and the second end in a pretensioned condition is designed in the range between 200% and 500% of the distance of a first terminal position of the roller carriage, which corresponds to the closed position of the sliding door, and a second terminal position of the roller carriage, which corresponds to the opened position of the sliding door. In the event the roller carriage is for example displaceable by 1 m between the two terminal positions, preferably the length of the elastic traction means is configured to be between 2 m and 5 m. Such an embodiment serves for allowing to choose materials with a higher degree of freedom, and nevertheless for providing preferred flat spring characteristics, respectively tensile stress characteristics. Such a relatively long traction means allows in particular for being able to built such flat spring characteristics, respectively flat tensile stress characteristics in an inexpensive and simple manner.

Likewise a subject matter of the present disclosure is a method for mounting an inventive sliding door installation including the following steps:

- inserting the roller carriage, in particular with a sliding door attached thereto, into the roller running track,
- connecting the first end of the elastic traction means to a point, which is stationary with regard to the roller running track,
- connecting the second end of the elastic traction means to the roller carriage while introducing tensile stress as a pretension into the elastic traction means.

By mounting an inventive sliding door installation, the same advantages are achieved as those explained in detail with regard to an inventive sliding door installation. Here, in particular the simplicity and the reduction of complexity already during mounting can be clearly seen for an inventive sliding door installation, respectively for an inventive method.

In particular in a pre-mounted closing device 40, the step of connecting the first end of the elastic traction means to a point, which is stationary with regard to the roller running track, by an installation technician during installation of the closing device may be omitted, because said method step has been already performed in the factory during pre-assembly.

BRIEF DESCRIPTION OF THE DRAWINGS

Further advantages, features and details of the disclosure will result from the following description, in which, reference being made to the drawings, several exemplary embodiments of the disclosure are described in detail. In the drawings it is diagrammatically shown in.

DETAILED DESCRIPTION OF THE DRAWINGS

Figure 1:
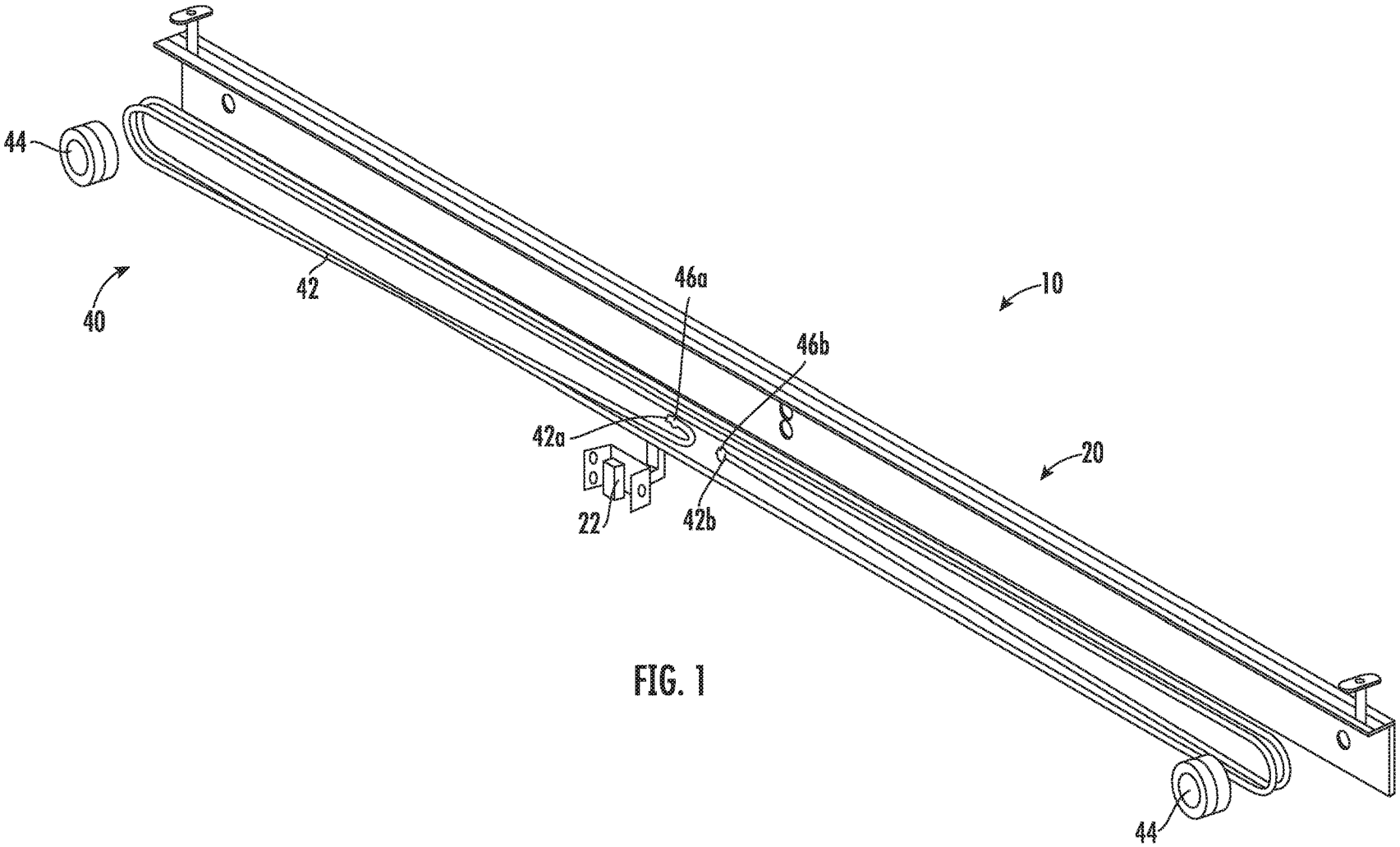
FIG. 1 an embodiment of an inventive closing device.

FIG. 1 shows how an inventive closing device 40 may be configured in a sliding door installation 10. Here, a part of the roller running track 20 is illustrated, which may be configured either as a covering or as a mounting interface for the attachment to a walling above a door opening. It can be well seen that the closing device 40 includes an elastic traction means 42 in the shape of a cord. In this case, it is a braided silicone rope, respectively a braided rubber rope, which is deflected about a corresponding redirection means 44. In this case, the redirection means 44 are configured as redirection rollers, which include ball bearings as a rotary support.

Moreover, in FIG. 1 the two ends 42*a* and 42*b* of the traction means 42 are seen. Here moreover, the connecting point 22 of the roller running track 20 can bee seen, to which the first end 42*a* of the elastic traction means 42 can be attached stationarily with regard to the roller running track 20. The further attachment of the second end 42*b* with the associated knot 46*b* will be explained later in detail with regard to FIG. 3.

The closing device 40 shown in FIG. 1 may also be in particular pre-mounted. This means that the structural components of the closing device 40 shown in the exploded illustration are located in their respective mounting position. This is advantageous in that the closing device 40 can be incorporated as a functional module into a sliding door installation 10 in a simple manner, what is also revealed in FIG. 2, which shows the pre-mounted closing device 40 in the condition incorporated into the sliding door installation 10. In the pre-mounted condition of the closing device 40, the traction means 42 is under pretension such that the traction means 42 is disposed in the closing device 40 in a captive manner.

Figure 2:
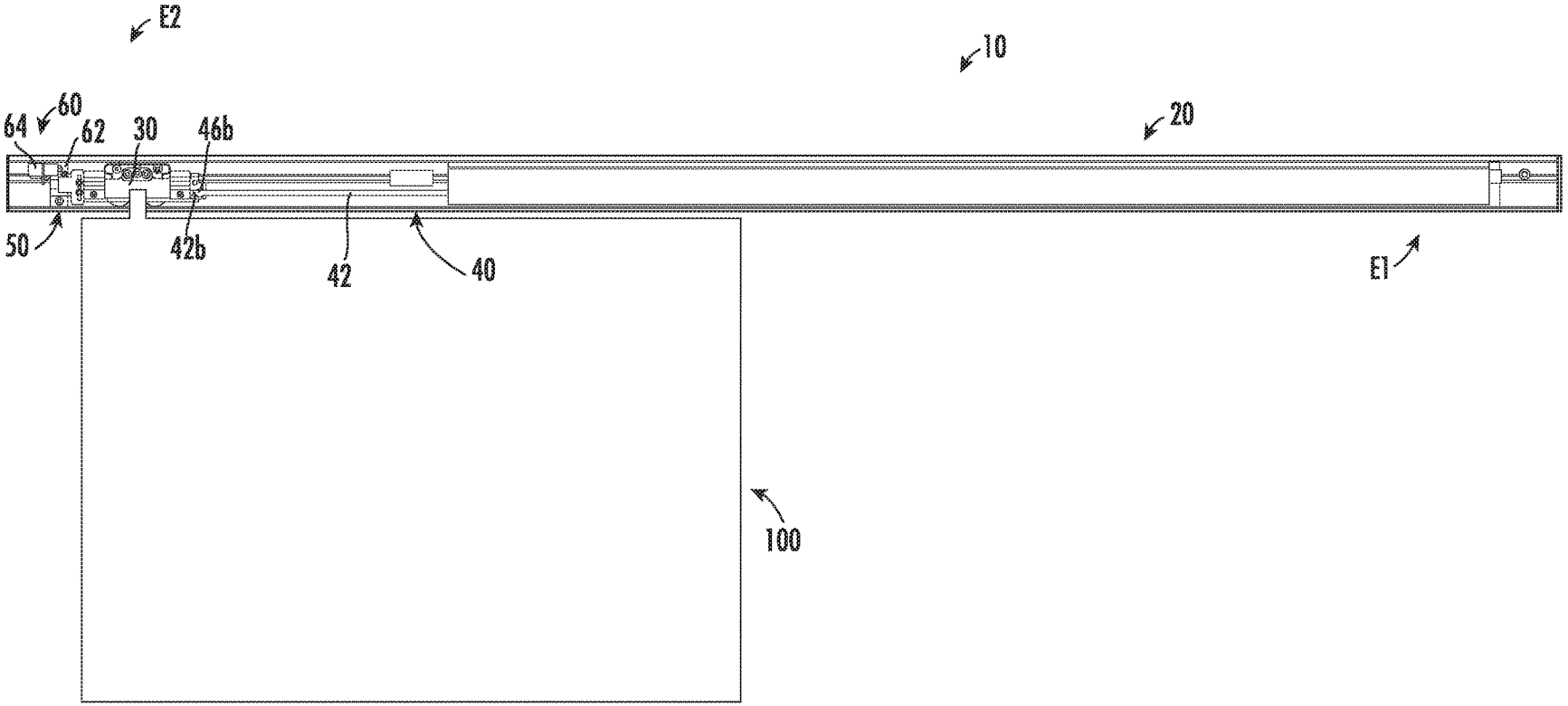
FIG. 2 the embodiment of FIG. 1 in the mounted situation of the sliding door installation, FIG. 3 a detail of the connection of the sliding door installation to the roller carriage, and FIG. 4 an embodiment of a latching device.

FIG. 2 shows diagrammatically how an end of a mounting method may be configured. Here, the roller running track 20 of the sliding door installation 10 is already attached to a walling above a door opening. A sliding door 100, here a single door leaf, is attached to a roller carriage 30. Here, the roller carriage 30 is in its second terminal position E2, which corresponds to the opened position of the sliding door 100. At the other end of the roller running track 20, the associated first terminal position E1 can be seen, which corresponds to the position opposite the closed position of the sliding door 100. Also, in this case it is again revealed how, at this end of the opened position, an additional functionality is given. In this case, on the one hand, it is question of a dampening device 50 and on the other hand of a latching device 60 to be explained later. The connection of the closing device 40 to the roller carriage 30 will be subsequently explained in more detail with regard to FIG. 3.

Figure 3:
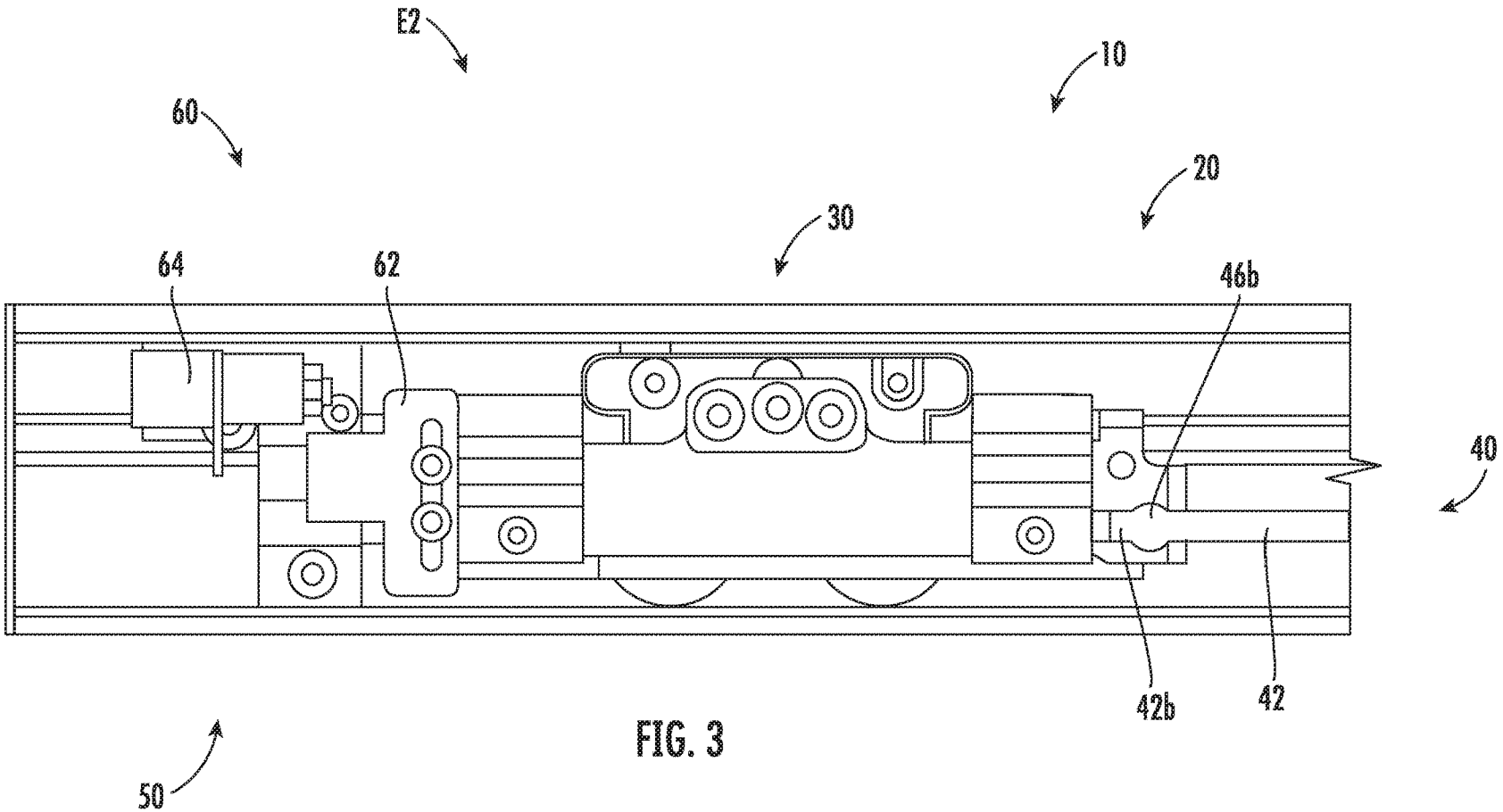

FIG. 3 shows diagrammatically a section of FIG. 2. Here, the roller carriage 30 can be very well seen with the connection of the traction means 42 with its second end 42*b* by means of a corresponding knot 46*b*. Here, the roller carriage 30 is located in the second terminal position E2 and in particular in a latched condition of the latching device 60. Here, the latching device 60 is for example configured as explained in more detail in FIG. 4. Thus, a fixing element 64 is stationarily attached to the roller running track 20. A mobile latching element 62 travelling along of the roller carriage 30 may latch and unlatch. Thus, latching is realized in a reversible manner.

Figure 4:
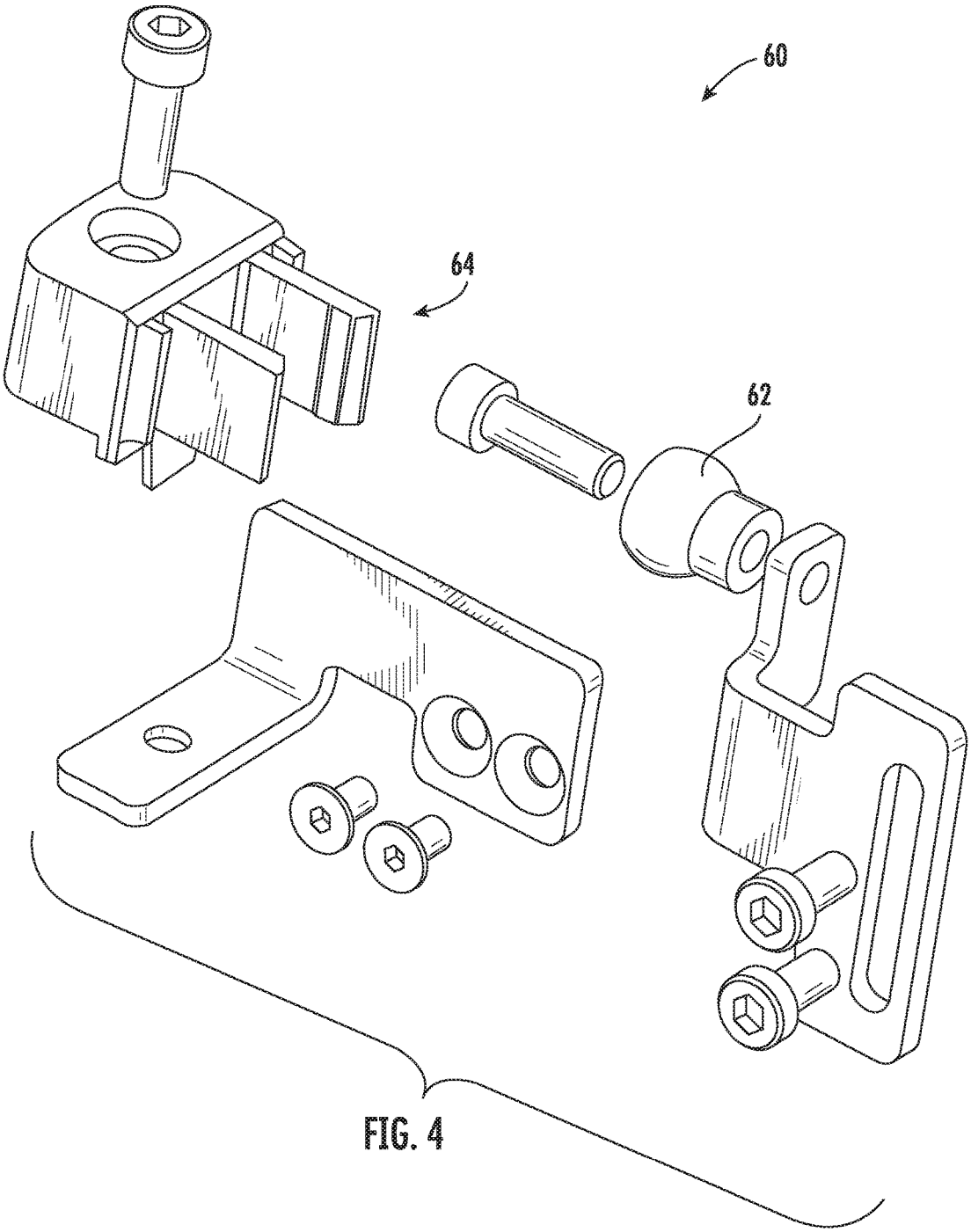

FIG. 4 shows diagrammatically one possible embodiment of such a latching device 60. A mobile latching element 62 in the form of a ball-shaped head is intended for mounting to the roller carriage 30. A fixing element 64 can be attached stationarily with regard to the roller running track 20. In the event now correspondingly the ball-shaped head of the mobile latching element 62 engages in the fixing element 64, the latching is realized and thereby the securing against the automatic closing movement. By releasing said reversible latching, the tensile stress of the traction means 42 can be released, whereby a corresponding application of force moves the roller carriage from the second terminal position E2 into the first terminal position E1.

The above explanation is an exclusive description of examples. Obviously, individual features of the embodiments, as long as they are technically reasonable, can be freely combined with each other without leaving the scope of the present disclosure.

The invention claimed is:

1. A sliding door installation, including a roller running track and at least one roller carriage supported to be displaceable in the roller running track, at which carriage a sliding door is attached, wherein a closing device is provided with an elastic traction means, wherein a first end of the elastic traction means is stationarily attached with regard to the roller running track, and a second end of the elastic traction means is attached to the at least one roller carriage for changing a tensile stress in the elastic traction means during a movement of the roller carriage in the roller running track, wherein the first end of the elastic traction means is attached with a first knot stationarily with regard to the roller running track or the second end of the elastic traction means is attached with a second knot to the at least one roller carriage, wherein the elastic traction means includes a monofile woven wrapping configured to loosen the knot.

2. The sliding door installation according to claim 1, wherein the closing device includes at least one redirection means, around which the elastic traction means is guided between the first end and the second end for a lengthening of a geometrical extension of the elastic traction means.

3. The sliding door installation according to claim 1, wherein the closing device or the elastic traction means meets at least one of the following parameters:

maximum tensile stress with the sliding door being opened between 20 N and 35 N, maximum tensile stress with the sliding door being closed between 10 N and 25 N, difference between tensile stress with the sliding door being opened and tensile stress with the sliding door being closed between 5 N and 25 N, length of the elastic traction means in a neutral fiber between 4 m and 5 m in a mounting condition, and exterior diameter of the elastic traction means being 5 mm to 8 mm.

4. The sliding door installation according to claim 1, wherein the first end of the elastic traction means is attached with a first knot to the at least one roller carriage or the second end of the elastic traction means is attached with a second knot stationarily with regard to the roller running track.

5. The sliding door installation according to claim 1, wherein a dampening device is provided for dampening the movement of the roller carriage exclusively into a first terminal position, which corresponds to a closed position of the sliding door.

6. The sliding door installation according to claim 1, wherein a latching device is provided with a mobile latching element, which is disposed at the roller carriage, and with a stationary fixing element in relation to the roller running track for a reversible latching cooperation with the mobile latching element in the roller carriage in a second terminal position, which corresponds to an opened position of the sliding door.

7. The sliding door installation according to claim 6, wherein the latching device includes a trigger function for cancelling the latching cooperation between the latching element and the fixing element during a movement of the roller carriage beyond the second terminal position.

8. The sliding door installation according to claim 1, wherein the elastic traction means includes at least one of the following embodiments:

a woven rubber cord, a silicone round cord, and a silicone tube.

9. The sliding door installation according to claim 1, wherein the elastic traction means has tensile stress characteristics with a difference of the tensile stress in the elastic traction means between a first terminal position of the roller carriage, which corresponds to a closed position of the sliding door, and a second terminal position of the roller carriage, which corresponds to an opened position of the sliding door, wherein the difference is designed between 50% and 200% of the pretension of elastic traction means in the first terminal position of the roller carriage.

10. The sliding door installation according to claim 1, wherein a length of the elastic traction means between the first end and the second end in a pretensioned condition is designed in the range between 200% and 500% of the distance of a first terminal position of the roller carriage, which corresponds to a closed position of the sliding door, and a second terminal position of the roller carriage, which corresponds to an opened position of the sliding door.

11. A method for mounting a sliding door installation having the features of claim 1, including the following steps:

inserting the roller carriage with a sliding door attached to the roller carriage, into the roller running track, connecting the first end of the elastic traction means to a point, which is stationary with regard to the roller running track, connecting the second end of the elastic traction means to the roller carriage while introducing the tensile stress as a pretension into the elastic traction means.

* * * * *